US005980057A

United States Patent [19]

Christie

[11] Patent Number: 5,980,057

[45] Date of Patent: Nov. 9, 1999

[54] SPEAKER LIGHT UNIT CONNECTED TO CONVENTIONAL ELECTRICAL LIGHT SOCKET

[75] Inventor: Cary Christie, Terrace, Nev.

[73] Assignee: Recoton Corporation, Lake Mary, Fla.

[21] Appl. No.: 09/153,286

[22] Filed: Sep. 15, 1998

Related U.S. Application Data

[60] Provisional application No. 60/065,008, Nov. 10, 1997.

[51] Int. Cl.[6] ..... F21V 33/00

[52] U.S. Cl. ..... 362/86; 362/234; 362/253

[58] Field of Search ..... 362/86, 87, 234, 362/253

[56] References Cited

U.S. PATENT DOCUMENTS

| | | | |
|---|---|---|---|
| 2,924,661 | 7/1960 | Messeas, Jr. . | |
| 3,194,952 | 7/1965 | Wells | 362/86 |
| 4,528,620 | 7/1985 | Weber | 362/86 |
| 4,776,018 | 10/1988 | Cordier | 381/88 |
| 5,772,307 | 6/1998 | Philyaw | 362/86 |

*Primary Examiner*—Stephen Husar

*Attorney, Agent, or Firm*—Levisohn, Lerner, Berger & Langsam

[57] ABSTRACT

An integrated light-speaker assembly suitable for connection into conventional electrical sockets. The combination includes an FM wireless receiver operating within a local area wireless transmission system. The speaker is mounted behind the light bulb, and when mounted into a conventional electrical socket, the assembly provides both sound and light, with the sound being provided by the local area wireless FM transmission system.

11 Claims, 2 Drawing Sheets

SPEAKER LIGHT UNIT CONNECTED TO CONVENTIONAL ELECTRICAL LIGHT SOCKET

This application claims benefit of Provisional application Ser. No. 60/065,008 filed Nov. 10, 1997.

BACKGROUND AND SUMMARY OF THE INVENTION

This invention relates to a speaker system arranged in a housing adapted to be inserted in a conventional electrical socket such as that used for light bulbs and floodlights.

900 MHz wireless transmission has enabled greater utilization of effective wireless FM audio transmission. A preferred 900 MHz system to be used in this invention is that identified in U.S. Pat. No. 5,410,735 entitled WIRELESS SIGNAL TRANSMISSION SYSTEMS, METHODS AND APPARATUS issued on Apr. 25, 1995 to Robert M. Borchardt et al. This patent is incorporated herein by reference.

An object of this invention is to provide a speaker which is connected to a conventional electrical bulb socket of the threaded or bayonet type so that power tothe speaker is provided by the power normally provided to the appliance placed in the socket. In a preferred embodiment, an appliance, such as an electric bulb, is integrated with a speaker in a single integral unit so that the same electrical socket powers both the electrical speaker as well as the electrical bulb. Additionally the device may include a rechargeable battery to enable it to operate without the light being powered.

This invention may find wide acceptance in environments in industrial, commercial and consumer environments where background music is played.

DETAILED DESCRIPTION

Figure 1:
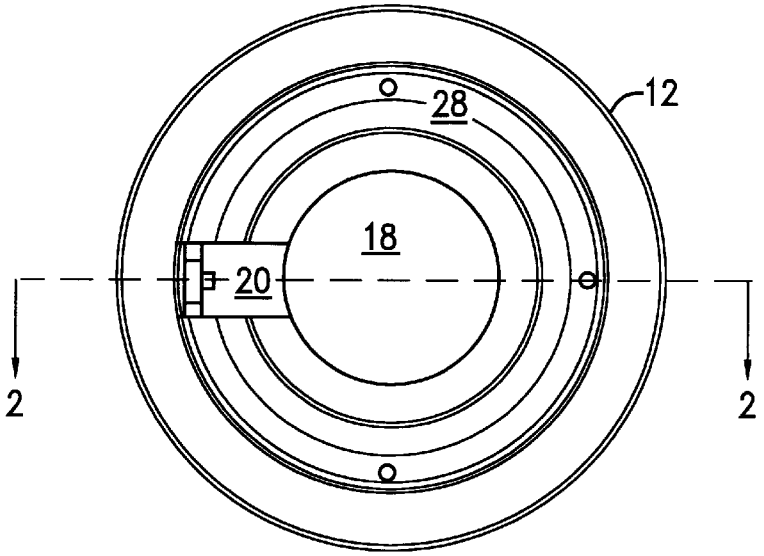
FIG. 1 is a front view of an embodiment of the invention showing the bulb surrounded by a speaker sitting within a conventional can type floodlight.
Figure 2:
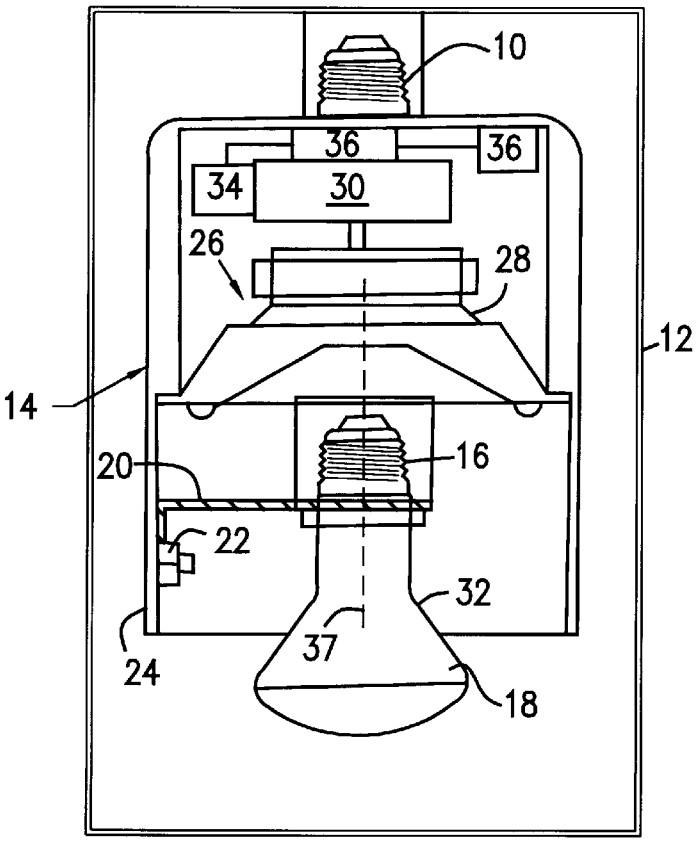
FIG. 2 is a sectional view along lines 2—2 of FIG. 1.

FIGS. 1 and 2 show a threaded upper end 10 adapted to fit into a conventional electrical socket, such as found in ceiling sockets. Threaded upper end 10 is formed as part of a cylindrical can light housing 12 and is adapted to receive an integrated speaker-light assembly 14. The speaker-light assembly 14 includes a forward or lower conventional electrical screw type socket 16 into which a floodlight or conventional electrical bulb 18 is screwed. Socket 16 is electrically connected with threaded upper end 10. A support structure 20 holding the floodlight 18 in place as well as the housing therefor is attached by means of a bolt 22 to a side wall 24 of the integrated assembly 14. A speaker section 26 of integrated unit 14 includes a speaker assembly 28 powered by a wireless FM receiver 30 electrically connected to power speaker 26. The wireless receiver 30 may be that described in U.S. Pat. No. 5,410,735 identified above in this patent application or any other wireless receiver suitable to operate for wireless reception of locally transmitted signals. The wireless receiver provides sufficient electrical power signals which cause audio to project from speaker assembly 28.

The receiver may be of the type that automatically locks onto a transmission frequency, and if the transmission frequency changes, there is no need to manually reset the tuning of the receiver. This is important because once the speaker-light housing is installed in a ceiling, it may be very difficult if not impossible to easily adjust the reception frequency, if the transmission frequency changes. In particular, this device is intended to work with a 900 MHz band transmission receiver apparatus, and in its preferred embodiment with the downconverter identified in the '735 patent. In such downconverters, there are tuning stages in the range of commercial FM stations. It is necessary to ensure that the receiver does not inadvertently pick up local FM transmission which could interfere with the local area transmission network identified in the '735 patent. Thus, this system contemplates the use of a local area wireless FM transmitter with the wireless FM receiver 30 located with the speaker-light assembly.

The integrated assembly 14 is threaded into a ceiling socket 10 in the conventional manner, and the electrical power normally available for an electrical spotlight bulb is now used to power the wireless FM receiver 30 as well as electrical bulb 18 and speaker 26. The rear surface 32 of spotlight bulb 18 serves as a wave guide for the sound emanating from the speaker 28. A rechargeable battery 34 is electrically connected to receive power from socket 10 enabling the operation of the wireless FM receiver 30 without turning on light 18. Amplifier 38, power supply 36 and rechargeable battery 34 are connected in the same manner as are the corresponding elements in the embodiment of FIG. 3, which are described below.

Speaker 26 and light bulb 18 have a common axis 37 which passes through both elements so that they are aligned within housing 14.

The 900 MHz wireless system described in the '735 patent allows for wireless transmission of up to 150 feet. Greater range may be able to be provided, but such range will be sufficient for most industrial and commercial applications.

Figure 3:
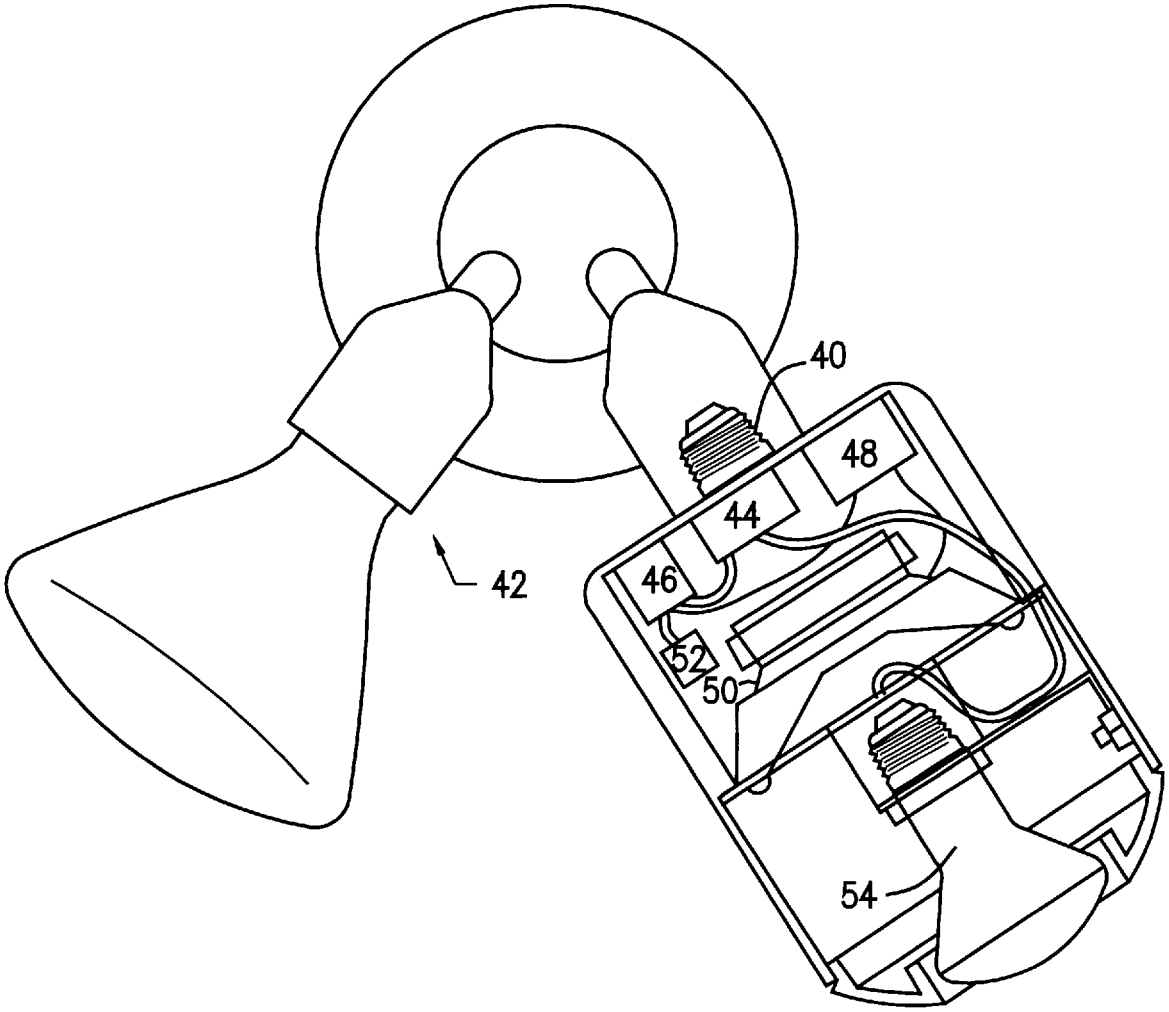
FIG. 3 is another embodiment of the present invention with an outdoor floodlight socket arrangement.

Reference is now made to FIG. 3 in which another embodiment of the invention is described which illustrates an outdoor floodlight-speaker that contains the socket into which the unitary speaker light assembly is inserted. In particular, socket 40 is a conventional socket found for a conventional outdoor floodlight 42, and a power supply 44 is connected to a rechargeable battery 46 and to amplifier 48. Amplifier 48 is connected to speaker 50 to power the speaker. Wireless FM receiver 52 is also connected to battery 46 to operate the wireless FM receiver. Speaker 50 (of FIG. 3) is substantially similar in description to speaker 28 (of FIGS. 1 and 2), and the manner of retaining a floodlight 54 in the assembly of FIG. 3 is substantially identical to the structure for holding floodlight 18 in FIGS. 1 and 2. Additionally, the operation and structure of the power supply 44 and amplifier 48 of FIG. 3 are substantially similar to that of power supply 36 and amplifier 38 of FIGS. 1 and 2. Electrical connections of FIG. 3 are substantially similar to the electrical connections in FIGS. 1 and 2. Therefore, a repeat of the connection and function of power supply 36 and amplifier 38 as well as rechargeable battery 34 is deemed unnecessary.

While the invention has been described with respect to particular applications, it will be appreciated that the described display may be used for other purposes. Many other variations and applications of the invention will be apparent. The above specification and the detailed description of the preferred embodiment are to be considered as representative only, as the scope of the invention is intended to be covered by the scope of the claims, as interpreted by the Courts, and their reasonable and legal equivalents, as also interpreted by the Courts and the applicable statutes.

What is claimed is:

1. An integrated speaker light assembly for use with conventional electrical light sockets, said assembly comprising a housing containing a speaker, a wireless FM receiver and amplifier connected to said speaker, said housing comprising a member for connection with said conventional electrical light socket to provide electrical power for said wireless FM receiver and amplifier, said housing further comprising a socket for a conventional light source so that said light source is integrated into said integrated light assembly.

2. An integrated speaker light assembly according to claim 1, wherein said member for connection to said conventional electrical light socket is threaded.

3. An integrated speaker light assembly according to claim 1, wherein said speaker is physically located behind said light source.

4. An integrated speaker light assembly according to claim 2, wherein said speaker is physically located behind said light source.

5. An integrated speaker light assembly according to claim 3, wherein said light source comprises a tapered light bulb, with the rear surface of said light bulb serving as a radiator for sound emanating from said speaker.

6. An integrated speaker light assembly according to claim 4, wherein said light source comprises a tapered light bulb, with the rear surface of said light bulb serving as a radiator for sound emanating from said speaker.

7. An integrated speaker light assembly according to claim 2, wherein said speaker has an axis through the center thereof, wherein the axis of said speaker is aligned with the axis of said light source.

8. An integrated speaker light assembly according to claim 1, wherein said housing comprises a cylindrical can shape.

9. An integrated speaker light assembly according to claim 4, wherein said housing comprises a cylindrical can shape.

10. An integrated speaker light assembly according to claim 1, further comprising a rechargeable power supply contained within said housing permitting operation of said wireless receiver without the light source being turned on.

11. An integrated speaker light assembly according to claim 1, further comprising a local area FM transmission system comprising an FM transmitter transmitting to said FM receiver, wherein said FM receiver comprises FM auto lock means to automatically lock the FM receiver to the frequency of the transmitted signal emitted by said FM transmitter.

* * * * *